US005615495A

United States Patent [19]

Mastrocola

[11] Patent Number: 5,615,495

[45] Date of Patent: Apr. 1, 1997

[54] INSULATING SOLE COVER

[76] Inventor: Todd L. Mastrocola, 221 Stocker Ave., King of Prussia, Pa. 19406

[21] Appl. No.: 546,697

[22] Filed: Oct. 23, 1995

[51] Int. Cl.[6] ..... A43B 13/38

[52] U.S. Cl. ..... 36/7.1 R; 36/2.6; 36/25 R

[58] Field of Search ..... 36/2.6, 4, 7.1 R, 36/7.3, 7.4, 7.5, 25 R, 135

[56] References Cited

U.S. PATENT DOCUMENTS

| | | | |
|---|---|---|---|
| 204,483 | 6/1978 | Cunningham | 36/7.5 |
| 2,032,052 | 2/1936 | Friedenberg | 36/7.3 |
| 2,469,969 | 5/1949 | Lee | 36/7.3 |
| 2,897,610 | 8/1959 | Campagna | 36/4 |
| 3,493,986 | 2/1970 | Erwin | 36/2.6 |
| 4,658,515 | 4/1987 | Oatman | 36/2.6 |
| 4,813,160 | 3/1989 | Kuznetz | 36/3 B |
| 5,315,767 | 5/1994 | Bradbury | 36/7.1 R |

*Primary Examiner*—Marie D. Patterson

[57] ABSTRACT

An insulating sole cover including an upper portion that has a top panel with a flat portion and a heel portion with an arc portion therebetween. The top panel has an outer rim with a top side wall extending upward therefrom. Also included is a bottom portion that has a bottom panel that is rigid along a bottom surface. The bottom panel has a bottom rim with a bottom side wall that extends upward therefrom. The bottom side wall is capable of being sealed to the top rim of the top side wall to form an interior area therebetween. Included are a plurality of cells. The cells are formed within the bottom portion and are proportionately dispersed within the interior area of the top panel and the bottom panel. Each cell has a filler contained therein to provide insulation from cold. Lastly, a plurality of openings are positioned within within the spacing between each cell. The openings are capable of decreasing the compaction coefficient of the filler within the interior area.

7 Claims, 3 Drawing Sheets

INSULATING SOLE COVER

BACKGROUND OF THE INVENTION

1. Field of the Invention

The present invention relates to a insulating sole cover and more particularly pertains to allowing the sole of a work boot to be covered by the insulating covering and further allowing the insulating covering to protect the foot within the boot from extreme temperatures.

2. Description of the Prior Art

The use of sole cover is known in the prior art. More specifically, sole covers heretofore devised and utilized for the purpose of covering shoe soles are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,315,767 to Bradburg discloses a shoe sole saver U.S. Pat. No. 4,259,791 to Brazan discloses a skier's toe and foot insulator. U.S. Pat. No. 3,898,749 to Famolare, Jr. discloses a removable sole for shoe skate. U.S. Pat. No. 322,154 to Trueman discloses a sole for a boot. Lastly, U.S. Pat. No. 293,273 to de Meij discloses a boot sole.

While these devices fulfill their respective, particular objectives and requirements, the aforementioned patents do not describe an insulating sole cover that is a removable and lightweight covering for a work boot sole and provides insulation against extreme temperatures when placed over the boot sole.

In this respect, the insulating sole cover according to the present invention substantially departs from the conventional concepts and designs of the prior art, and in doing so provides an apparatus primarily developed for the purpose of allowing the sole of a work boot to be covered by the insulating covering and further allowing the insulating covering to protect the foot within the boot from extreme temperatures.

Therefore, it can be appreciated that there exists a continuing need for a new and improved insulating sole cover which can be used for allowing the sole of a work boot to be covered by the insulating covering and further allowing the insulating covering to protect the foot within the boot from extreme temperatures. In this regard, the present invention substantially fulfills this need.

SUMMARY OF THE INVENTION

In view of the foregoing disadvantages inherent in the known types of sole cover now present in the prior art, the present invention provides an improved insulating sole cover. As such, the general purpose of the present invention, which will be described subsequently in greater detail, is to provide a new and improved insulating sole cover and method which has all the advantages of the prior art and none of the disadvantages.

To attain this, the present invention essentially comprises an upper portion. The upper portion has a generally rectangular top panel with a flat portion and a heel portion with an arc portion therebetween. The top panel has an outer rim with a top side wall extending upward therefrom. The top side wall wraps around the top panel along the outer rim. The top side wall has an increasing height from the outer rim to a top rim. The height of the top side wall, around the heel portion, is greater than the height of the top side wall around the front portion. Also, a bottom portion is included. The bottom portion has a generally rectangular bottom panel that is rigid along a bottom surface. The bottom portion is formed of a rubberized material cured in a mold. The bottom panel has a bottom rim with a bottom side wall extending upward therefrom. The bottom side wall has a width of about two and one half inches and wraps around the bottom panel along the bottom rim. The bottom side wall is heat sealed to the top rim of the top wall to form an interior area between the top panel and the bottom panel. The top panel is attache to the bottom panel to form a sole cover that is capable of being positioned over the sole of a work boot. A plurality of generally rectangular cells are provided. The cells are formed during the curing process of the bottom portion and are positioned within the interior area of the top panel and the bottom panel. The plurality of cells are proportionately dispersed within the interior area. Each cell has a cubic diameter between about one half inch to three-fourths inch. Each cell has a fiberglass filler contained therein. The fiberglass filler of each cell is capable of providing insulation from cold and when the sole cover is positioned on the sole of the work boot. Lastly, a plurality of cylindrical openings are included. The openings are positioned within the interior area and within the spacing between each cell. The cylindrical openings are formed during the curing process of the bottom portion. Each opening has a diameter of about one-fourth inch and a height of about three-fourth inch. Each opening is formed adjacent to more than one of the plurality of cells. The plurality of cylindrical openings are capable of decreasing the compaction coefficient of the fiberglass filler of the plurality of cells within the interior area.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved insulating sole cover which has all of the advantages of the prior art sole cover and none of the disadvantages.

It is another object of the present invention to provide a new and improved insulating sole cover which may be easily and efficiently manufactured and marketed.

It is further object of the present invention to provide a new and improved insulating sole cover which is of durable and reliable constructions.

An even further object of the present invention is to provide a new and improved insulating sole cover which is susceptible of a low cost of manufacture with regard to both materials and labor, and which accordingly is then susceptible of low prices of sale to the consuming public, thereby making such insulating sole cover economically available to the buying public.

Still yet another object of the present invention is to provide a new and improved insulating sole cover which provides in the apparatuses and methods of the prior art some of the advantages thereof, while simultaneously overcoming some of the disadvantages normally associated therewith.

Even still another object of the present invention is to provide a insulating sole cover for allowing the sole of a work boot to be covered by the insulating covering and further allowing the insulating covering to protect the foot within the boot from extreme temperatures.

Lastly, it is an object of the present invention to provide a new and improved insulating sole cover which includes an upper portion. The upper portion has a top panel with a flat portion and a heel portion with an arc portion therebetween. The top panel has an outer rim with a top side wall extending upward therefrom. Also included is a bottom portion that has a bottom panel that is rigid along a bottom surface. The bottom panel has a bottom rim with a bottom side wall that extends upward therefrom. The bottom side wall is capable of being sealed to the top rim of the top side wall to form an interior area therebetween. Included are a plurality of cells. The cells are formed within the bottom portion and are proportionately dispersed within the interior area of the top panel and the bottom panel. Each cell has a filler contained therein to provide insulation from cold and heat. Lastly, a plurality of openings are positioned within the interior area. The plurality of openings are positioned within the spacing between each cell. The plurality of openings are capable of decreasing the compaction coefficient of the filler within the interior area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
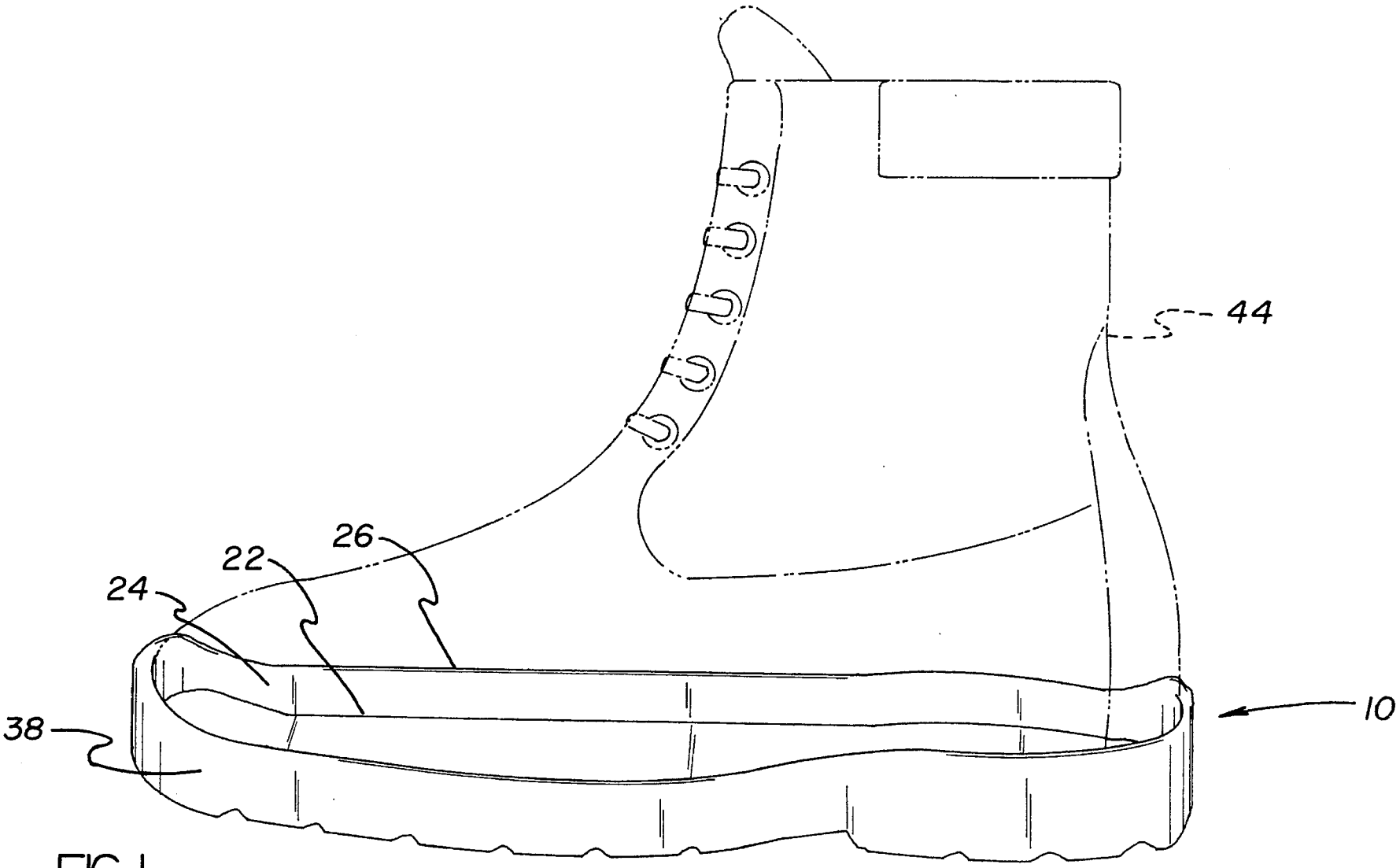
FIG. 1 is a perspective view of the preferred embodiment of the insulating sole cover constructed in accordance with the principles of the present invention.

With reference now to the drawings, and in particular to FIG. 1 thereof, the preferred embodiment of the new and improved insulating sole cover embodying the principles and concepts of the present invention and generally designated by the reference numeral 10 will be described.

The present invention, the insulating sole cover 10 is comprised of a plurality of components. Such components in their broadest context include an upper portion, a bottom portion, cells, and openings. Such components are individually configured and correlated with respect to each other so as to attain the desired objective.

Figure 3:
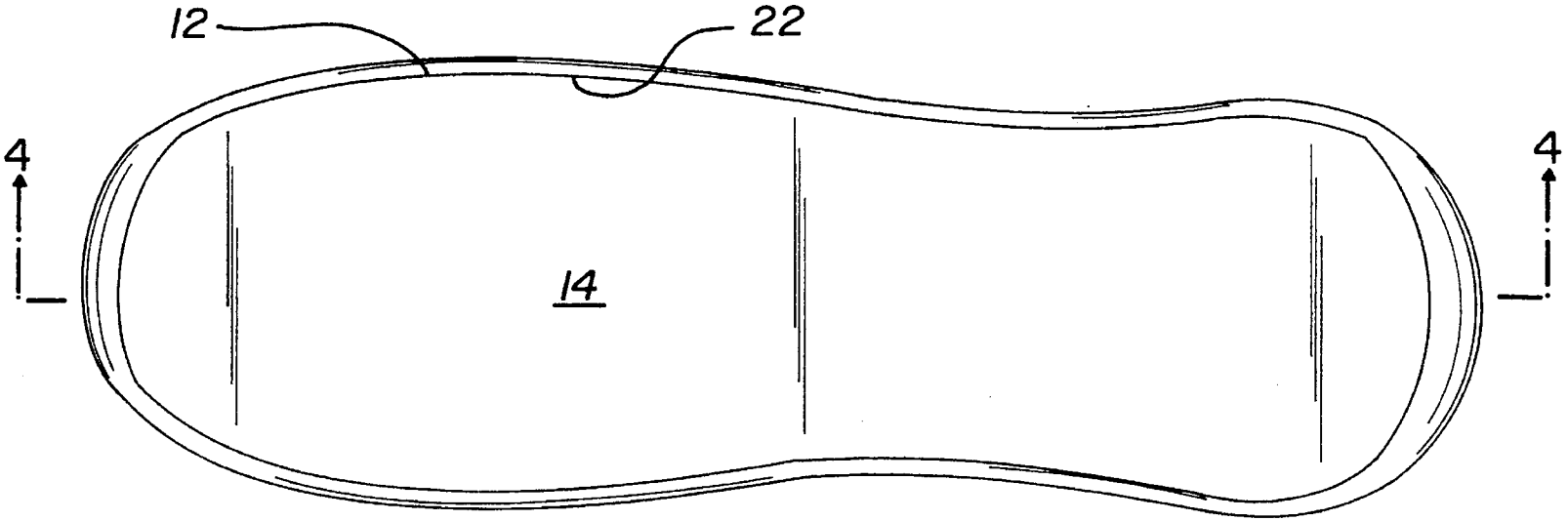
FIG. 3 is a top plan view of the present invention in an operable configuration.
Figure 4:
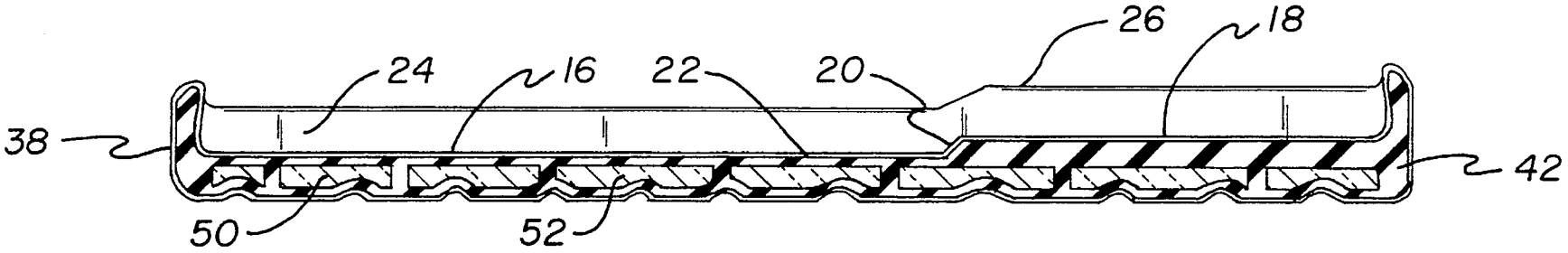
FIG. 4 is a side cross sectional view of the present invention along line 4—4 of FIG. 3.

Specifically, the present invention includes an upper portion 12, as shown in FIG. 3. The upper portion is formed of a rubberized material. This material prevents the boot sole from slipping. The upper portion has a generally rectangular top panel 14 with a flat portion 16 and a heel portion 18 with an arc portion 20 therebetween. FIG. 4, best illustrates the top panel with an outer rim 22 that has a top side wall 24 extending upward therefrom. The top side wall wraps around the top panel along the outer rim. The top side wall has an increasing height from the outer rim to a top rim 26. The height of the top side wall around the heel portion is greater than the height of the top side wall around the front portion. The height of the top side wall allows the top of the rim to fit over the edge of the sole of the work boot, as shown in FIG. 1.

Figure 2:
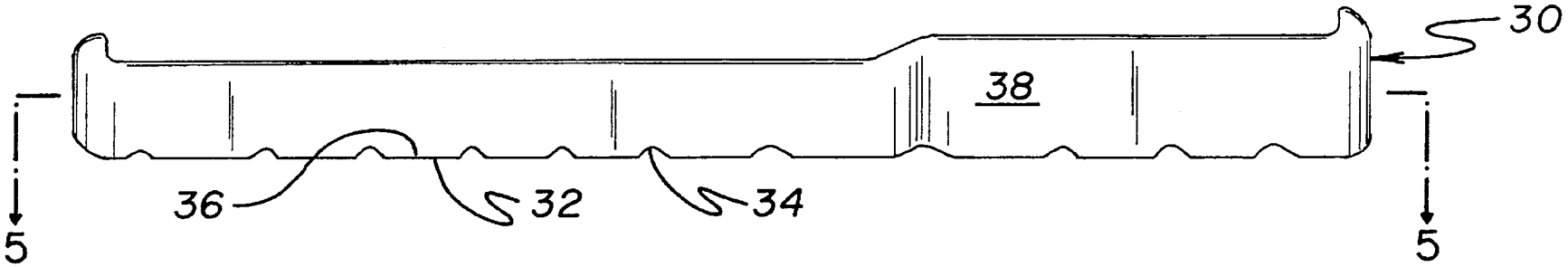
FIG. 2 is a side elevational view of the present invention in an operable configuration.

Also, a bottom portion 30 is included. The bottom portion has a generally rectangular bottom panel 32 that is rigid along a bottom surface 34. The rigid bottom surface ensures proper footing of the boot and the sole cover on a slippery surface. The bottom portion is formed of a rubberized material that is cured in a mold. The bottom panel has a bottom rim 36 with a bottom side wall 38 that extends upward therefrom, as shown in FIG. 2. The bottom side wall has a width of about two and one half inches and wraps around the bottom panel along the bottom rim. The bottom side wall is heat sealed to the top rim 26 of the top side wall 24. Heat sealing ensures that moisture will not seep between the covering points of the two panels. An interior area, as shown in FIG. 4, is formed between the top panel 14 and the bottom panel 32 when the bottom side wall is sealed to the top rim of the top side wall. The top panel, when attached to the bottom panel, forms a sole cover 10 that is capable of being positioned over the sole of a work boot as shown in FIG. 1.

As illustrated in FIG. 4, a plurality of generally rectangular cells 50 are formed during the curing process of the bottom portion 30. The plurality of cells are positioned within the interior area 42 of the top panel and the bottom panel. The plurality of cells are proportionately dispersed within the interior area. Each cell has a cubic diameter between about one half inch to three-fourth inch. Each cell has a fiberglass filler 52, as shown in FIG. 4, contained therein. The fiberglass filler of each cell provides insulation to the foot of the boot's wearer, from cold and heat, when the sole cover is positioned on the work boot.

Figure 5:
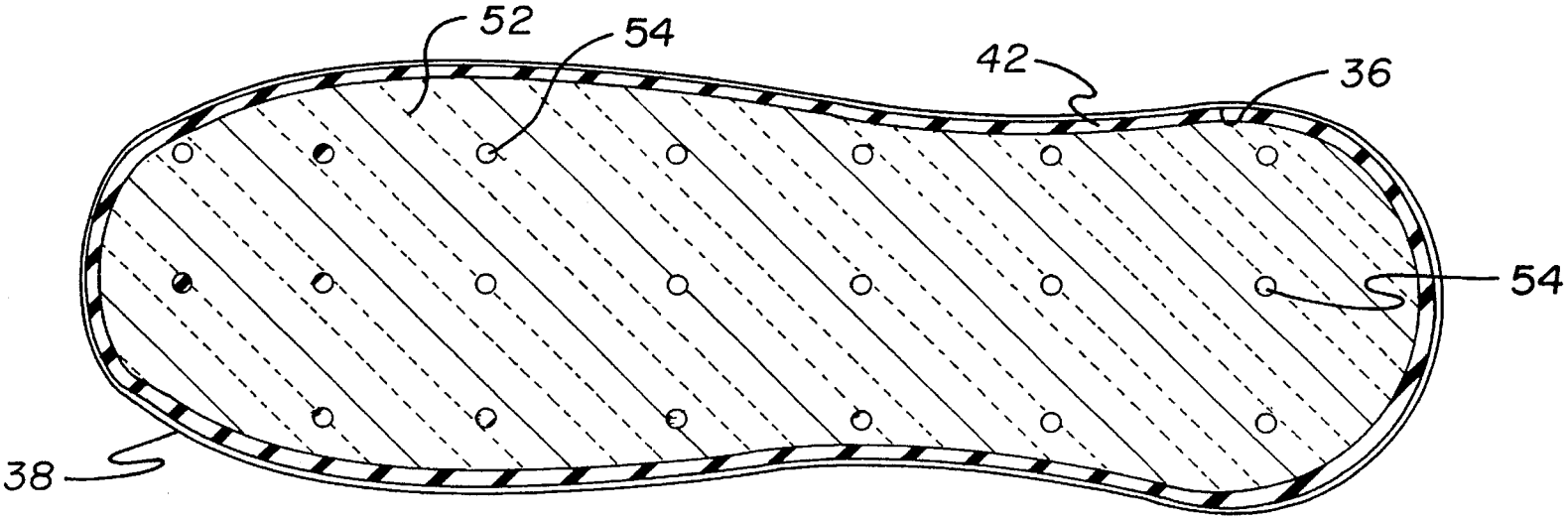
FIG. 5 is a cross sectional view of the present invention along line 5—5 of FIG. 2.

Finally, a plurality of cylindrical openings 54 are positioned within the interior area. The openings are contained, as shown in FIG. 5, within the spacing between each cell 50. The cylindrical openings are formed during the curing process of the bottom portion 30. Each opening has a diameter of about one-fourth inch and a height of about three-fourth inch. Each opening is formed adjacent to more than one of the plurality of cells. The plurality of cylindrical openings are capable of decreasing the compaction coefficient of the fiberglass filler of the plurality of the cells within the interior area. The cells increase the useable life of the insulating sole.

The present invention is a insulating sole cover for work boots that can be easily placed and removed from the work boots as needed. The sole cover is made from an upper portion and a bottom portion, both being formed of a rubberized material with the bottom portion being formed through a curing process. The insulating sole cover is lightweight. The insulation material used in the sole covering is a fiberglass filler. The fiberglass filler is capable of withstanding extreme temperatures, whether the temperatures are cold or hot. The insulating sole cover is very useful for people who have to work outside in extreme weather. The insulating properties of the sole cover prevents the foot within the work boots from being exposed to extreme temperatures along the foot bottom.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. The insulating sole cover comprising:

an upper portion having a top panel with a flat portion and a heel portion having an arch portion therebetween, the top panel having an outer rim with a top side wall extending upward therefrom;

a bottom portion having a bottom panel being ridged along a bottom surface, the bottom panel having a bottom rim with a bottom side wall extending upward therefrom, with the bottom side wall being attached to the top rim of the top side wall to form an interior area therebetween;

a plurality of cells formed within the bottom portion and being proportionately dispersed within the interior area of the top panel and the bottom panel, each cell having contained therein a filler; and a plurality of openings being positioned within the interior area of the filler and between each cell, the plurality of openings capable of decreasing the compaction coefficient of the filler within the interior area.

2. The insulating sole cover as set forth in claim 1 wherein the top panel having the top side wall wrapping therearound and along the outer rim, the top side wall having an increasing height extending upward from the outer rim to a top rim, the height of the top side wall, around the heel portion, being greater than the height of the top side wall, around the flat portion, of the top panel.

3. The insulating sole cover as set forth in claim 1 wherein the bottom portion being formed of a rubberized material cured in a mold and ridged along the bottom surface, and the bottom side wall having a width of about 2½ inches and wrapping around the bottom panel along the bottom rim, and the bottom side wall being heat sealed to the top rim for forming of an interior area between the top panel and the bottom panel.

4. The insulating sole cover as set forth in claim 3 wherein the plurality of cells and the plurality of openings being formed during the curing process of the bottom portion.

5. The insulating sole cover as set forth in claim 1 wherein each cell of the interior area of the bottom portion having a cubic diameter between about ½ inch to ¾ inch, and the filler being a fiberglass material capable of insulating a sole of a work boot.

6. The insulating sole cover as set forth in claim 1 wherein each opening having a diameter of about ¼ inch and a height of about ¾ inch and each opening being adjacent more than one of the plurality of cells within the interior area of the bottom portion.

7. A new and improved insulating sole cover for work boots comprising in combination:

an upper portion having a generally rectangular top panel with a flat portion and a heel portion having an arch portion therebetween, the top panel having an outer rim with a top side wall extending upward therefrom, the top side wall wrapping around the top panel along the outer rim, the top side wall having an increasing height from the outer rim to a top rim, the height of the top side wall around the heel portion being greater than the height of the top side wall around the flat portion;

a bottom portion having a generally rectangular bottom panel being ridged along a bottom surface, the bottom portion being formed of a rubberized material cured in a mold, the bottom panel having a bottom rim with a bottom side wall extending upward therefrom, the bottom side wall having a width of about 2½ inches and wrapping around the bottom panel along the bottom rim, the bottom side wall being attached to the top rim of the top side wall, and forming an interior area between the top panel and the bottom panel, the top panel being attached to the bottom panel forming a sole cover capable of being positioned over a sole of a work boot;

a plurality of generally rectangular cells being formed within the bottom portion and being positioned within the interior area of the top panel and the bottom panel, the plurality of cells being proportionately dispersed within the interior area, each cell having a cubic diameter between about ½ inch to ¾ inch, each cells having a fiberglass filler contained therein, the fiberglass filler of each cell being capable of providing an insulation from cold and heat when the sole cover being positioned on the sole of the work boot; and a plurality of cylindrical openings being positioned within the interior area of the filler and between each cell, each opening having a diameter of about ¼ inch and a height of about ¾ inch, each opening being formed adjacent more than one of the plurality of cells, the plurality of cylindrical openings being capable of decreasing the compaction coefficient of the fiberglass filler of the plurality of cells within the interior area.

* * * * *